US008939727B2

(12) United States Patent
Campbell et al.

(10) Patent No.: US 8,939,727 B2
(45) Date of Patent: Jan. 27, 2015

(54) TURBINE BLADE AND NON-INTEGRAL PLATFORM WITH PIN ATTACHMENT

(75) Inventors: Christian X. Campbell, Oviedo, FL (US); Darryl Eng, Stuart, FL (US); John J. Marra, Winter Springs, FL (US)

(73) Assignee: Siemens Energy, Inc., Orlando, FL (US)

( * ) Notice: Subject to any disclaimer, the term of this patent is extended or adjusted under 35 U.S.C. 154(b) by 657 days.

(21) Appl. No.: 13/227,603

(22) Filed: Sep. 8, 2011

(65) Prior Publication Data

US 2013/0064667 A1 Mar. 14, 2013

(51) Int. Cl.
*F01D 5/30* (2006.01)
*F01D 11/00* (2006.01)

(52) U.S. Cl.
CPC ..... *F01D 5/3007* (2013.01); *F01D 11/008* (2013.01)
USPC ..... 416/193 A

(58) Field of Classification Search
CPC ..... F01D 5/22; F01D 5/225; F01D 5/26; F01D 5/3007; F01D 11/006; F01D 11/008; F01D 5/3053
USPC ..... 416/190, 191, 193 A, 193 R, 194, 195, 416/196 R, 500
See application file for complete search history.

(56) References Cited

U.S. PATENT DOCUMENTS

| | | | | |
|---|---|---|---|---|
| 4,621,979 | A * | 11/1986 | Zipps et al. | 416/219 R |
| 6,273,683 | B1 | 8/2001 | Zagar et al. | |
| 6,464,456 | B2 * | 10/2002 | Darolia et al. | 415/134 |
| 6,910,854 | B2 * | 6/2005 | Joslin | 415/139 |
| 7,134,842 | B2 | 11/2006 | Tam et al. | |
| 7,163,375 | B2 | 1/2007 | Queriault et al. | |
| 7,329,087 | B2 * | 2/2008 | Cairo et al. | 415/135 |
| 7,690,890 | B2 | 4/2010 | Aotsuka et al. | |
| 7,762,780 | B2 | 7/2010 | Decardenas | |
| 7,762,781 | B1 | 7/2010 | Brown et al. | |
| 7,811,053 | B2 | 10/2010 | Balamucki et al. | |
| 2006/0245715 | A1 * | 11/2006 | Matsumoto et al. | 385/147 |
| 2008/0286106 | A1 * | 11/2008 | Keith et al. | 416/193 A |

* cited by examiner

*Primary Examiner* — Nathaniel Wiehe
*Assistant Examiner* — Kayla McCaffrey

(57) ABSTRACT

Platforms (36, 38) span between turbine blades (23, 24, 25) on a disk (32). Each platform may be individually mounted to the disk by a pin attachment (42). Each platform (36) may have a rotationally rearward edge portion (50) that underlies a forward portion (45) of the adjacent platform (38). This limits centrifugal bending of the rearward portion of the platform, and provides coolant sealing. The rotationally forward edge (44A, 44B) of the platform overlies a seal element (51) on the pressure side (28) of the forwardly adjacent blade, and does not underlie a shelf on that blade. The pin attachment allows radial mounting of each platform onto the disk via tilting (60) of the platform during mounting to provide mounting clearance for the rotationally rearward edge portion (50). This facilitates quick platform replacement without blade removal.

11 Claims, 5 Drawing Sheets

TURBINE BLADE AND NON-INTEGRAL PLATFORM WITH PIN ATTACHMENT

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

This invention relates to means for attaching blades and platforms to a turbine disc, and particularly to attaching platforms that are non-integral with the blades.

BACKGROUND OF THE INVENTION

A gas turbine blade can be cast of a high-temperature metal alloy in the form of a single crystal per blade to maximize strength. It is difficult and expensive to reliably cast an integral platform in a single-crystal blade casting, due to the complexity of the blade/platform shape and the corresponding complexity and size of the casing mold. Therefore, non-integral platforms have been attached to the turbine disk between blades.

For example, U.S. Pat. No. 4,621,979 shows non-integral platforms mounted by a pin and hinge structure. In this patent, a relatively simple blade shape is shown. However, modern turbine blades have a high pitch angle relative to the turbine axis, and high camber and thickness. This geometry requires a platform with a complex asymmetric perimeter, which complicates designing a platform that can be mounted and replaced between the blades. Axial mounting would require a very narrow platform of constant curvature. Radial mounting is difficult regarding sealing around the platform edges, and limiting asymmetric cantilevered centrifugal stress on the platform.

The present invention solves these problems. It allows the platforms to be mounted and removed radially, and to be sealed without removing any blades, thus providing fast platform replacement.

BRIEF DESCRIPTION OF THE DRAWINGS

The invention is explained in the following description in view of the drawings that show.

DETAILED DESCRIPTION OF THE INVENTION

Figure 1:
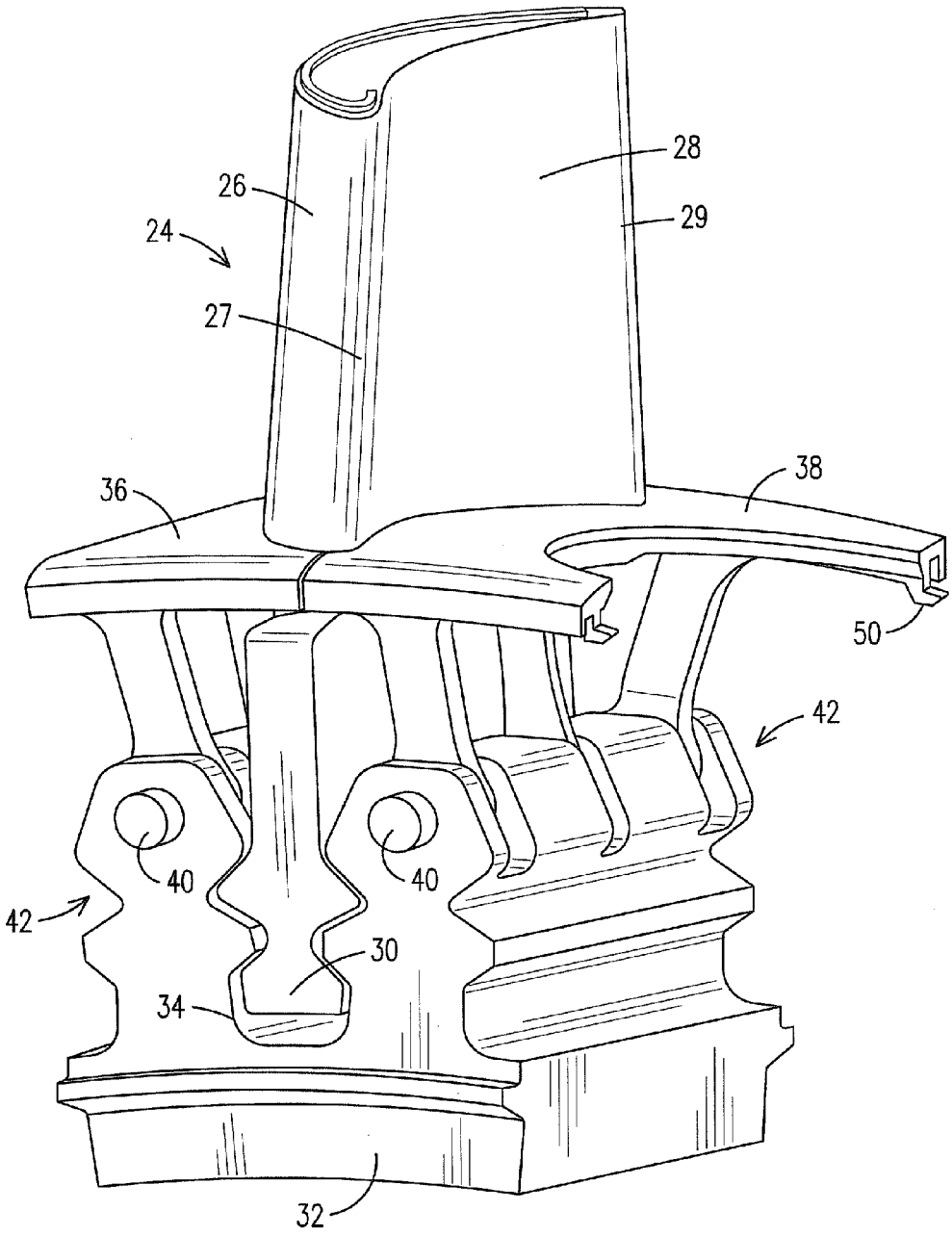
FIG. 1 is a perspective view of a turbine blade and two adjacent platforms mounted on the circumference of a turbine disk.

FIG. 1 shows a turbine blade 24 with a suction side 26, a leading edge 27, a pressure side 28, a trailing edge 29, and a shank 30. The shank may be formed in the known and illustrated fir tree shape for mounting to a turbine disk 32 by axial insertion into a mating slot 34 as known in the art. Herein, the terms "axial" and "radial" mean with respect to the disk rotation axis. Adjacent non-integral platforms 36, 38 are mounted individually to the disk 32 by a respective pin or bolt 40, for example with a clevis or hinge attachment 42.

Figure 2:
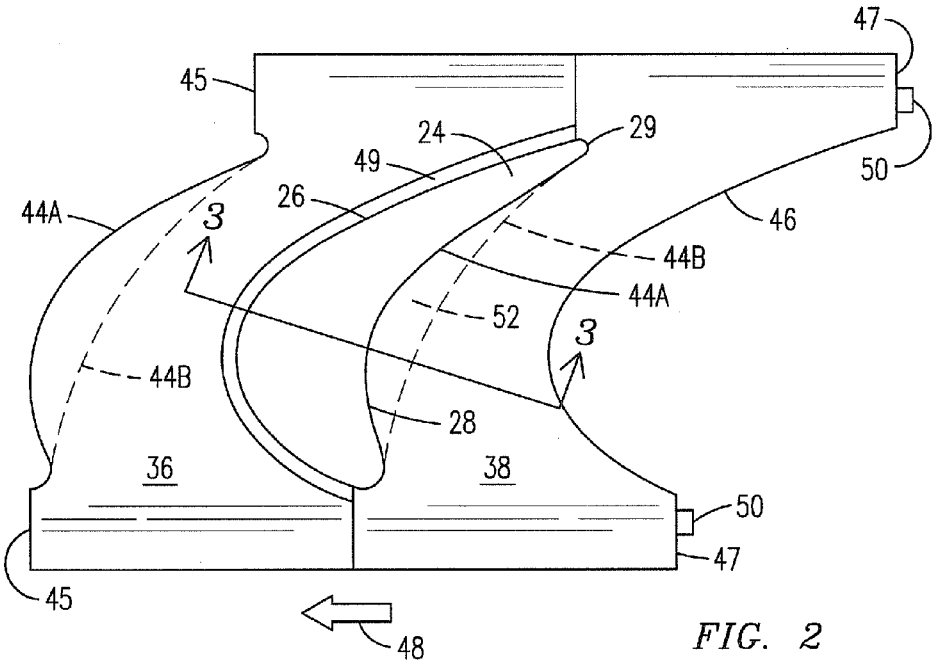
FIG. 2 is a top or radially outer view of FIG. 1.

FIG. 2 is a top or radially outer view of FIG. 1. Each platform 36, 38 has rotationally forward edge portions, 44A (or optionally 44B) and 45, and rotationally rearward edge portions 46, 47 with respect to the rotation direction 48 of the disk. Each platform may have one or more rotationally rearward edge lap portions 50 that underlie a forward edge portion 45 of the adjacent platform, forming a ship lap that eliminates cantilevered centrifugal bending of the rearward portions 47 of the platforms. A rotationally rearward central edge portion 46 may underlie a shelf 49 on the suction side of the adjacent blade for this same reason. The rotationally forward central edge portion 44A may follow the camber of the pressure side 28 of the adjacent blade 24, or it may follow a lesser curvature 44B. Herein "less curved" means a curve with a larger average radius (i.e. straighter) than another curve. For example the edge 44B may follow a circular arc between the leading and trailing edges 27, 29 of the blade 24, following a ridge 52 on the pressure side 28 of the blade.

Figure 3:
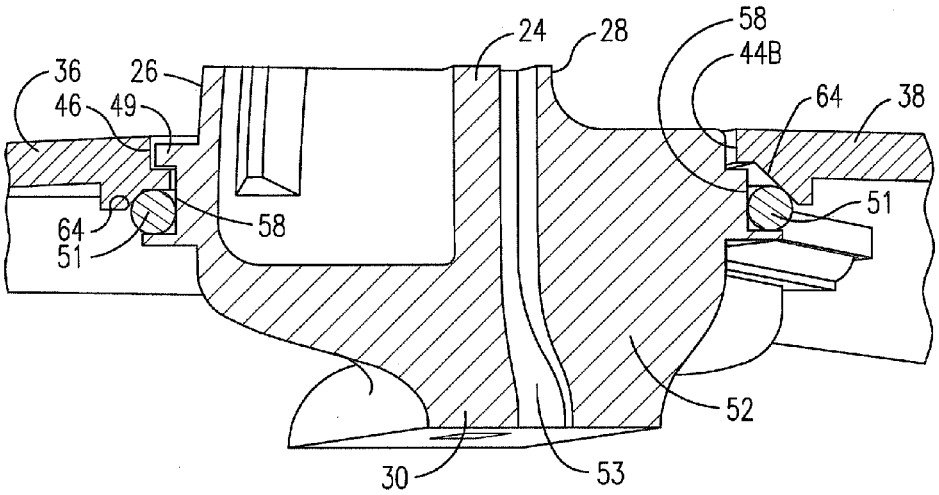
FIG. 3 is a sectional view taken along line 3-3 of FIG. 2.

FIG. 3 is a sectional view taken along line 3-3 of FIG. 2, showing the rotationally forward central edge portion 44B of platform 38 overlying a seal element 51 on the ridge 52 on the pressure side of the blade. This forward central edge portion 44B does not underlie a shelf on the pressure side of the blade, so as to allow mounting of the platform by tilted radial insertion as later described. Wedge portions 64 on the respective edges 46, 44*a* of the platforms 36, 38 cause the seal element 51 to wedge against the seal slot under centrifugal force for a tight seal. Cooling channels 53 may be provided in the blade as known.

Figure 4:
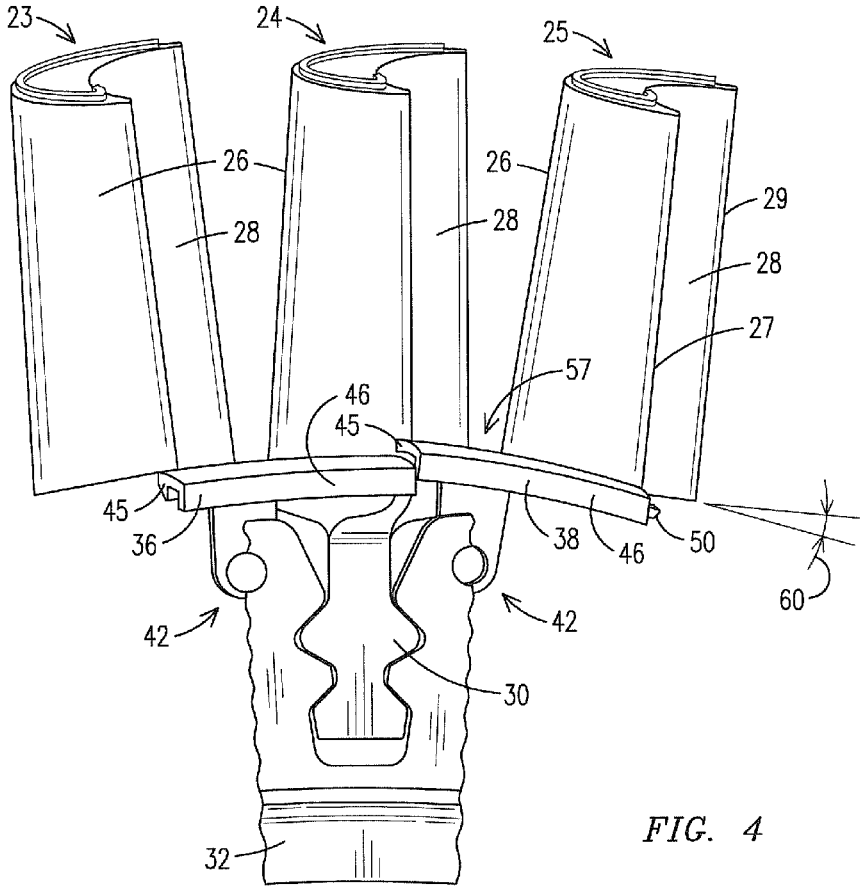
FIG. 4 is an axially front view looking aft at three turbine blades in a disk. The right platform is being mounted by tilted radial insertion.

FIG. 4 is an axially front view looking aft at three turbine blades 23, 24, 25 mounted in a disk 32. Each blade has a pressure side 26, a suction side 28, and a shank 30. Each shank is mounted to a turbine disk 32 by a fir tree structure. Platform 36 is mounted to the disk between the pressure side 28 of the first turbine blade 23 and the suction side 26 of the second turbine blade 24. Platform 38 is illustrated in the process of being mounted to the disk between the pressure side 28 of the second turbine blade 24 and the suction side 26 of the third turbine blade 25. In order to allow radial insertion 57 of the platform 38, the platform attachment 42 provides room to tilt the platform 38 at an angle 60 during mounting to provide mounting clearance between the rotationally rearward edge portions 50 and the overlapping portions 45 of the adjacent platform (not shown), and to provide clearance between the rearward edge portion 46 and the overlapping suction side shelf 49, if any, of the adjacent blade 25.

Figure 5:
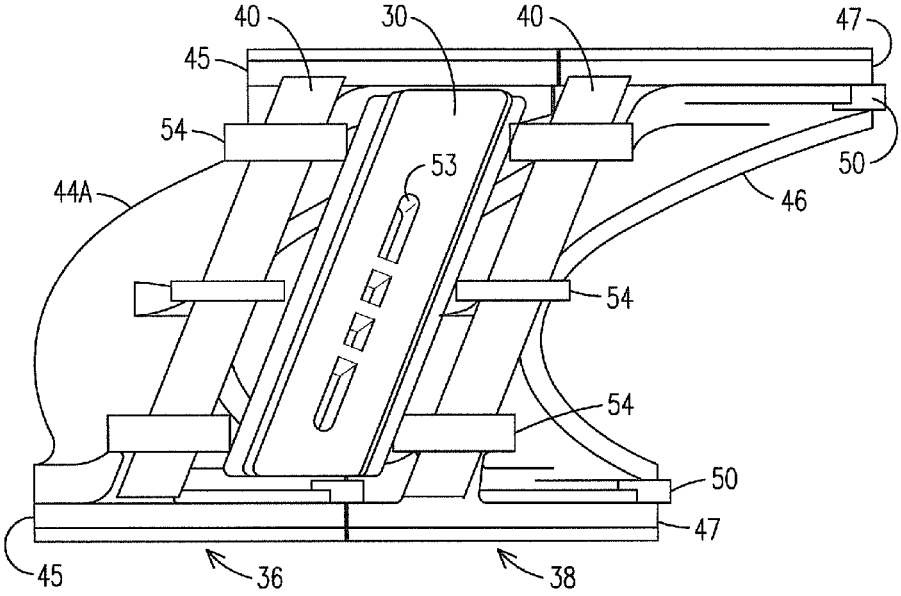
FIG. 5 is a bottom or radially inner view of FIG. 1.
Figure 6:
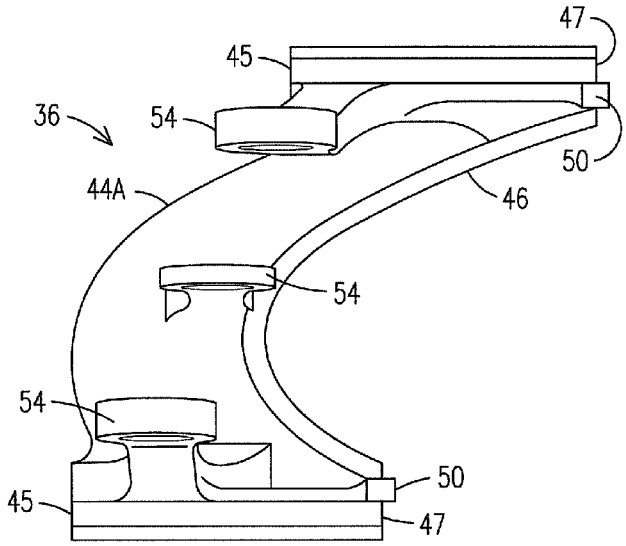
FIG. 6 is a bottom view of a detached platform.

FIG. 5 is a bottom or radially inner view of FIG. 1, showing cooling channels 53 in the blade shank 30 and lugs 54 on the platforms 36, 38 for the mounting pins or bolts 40. FIG. 6 is a bottom view of a detached platform 36.

Figure 7:
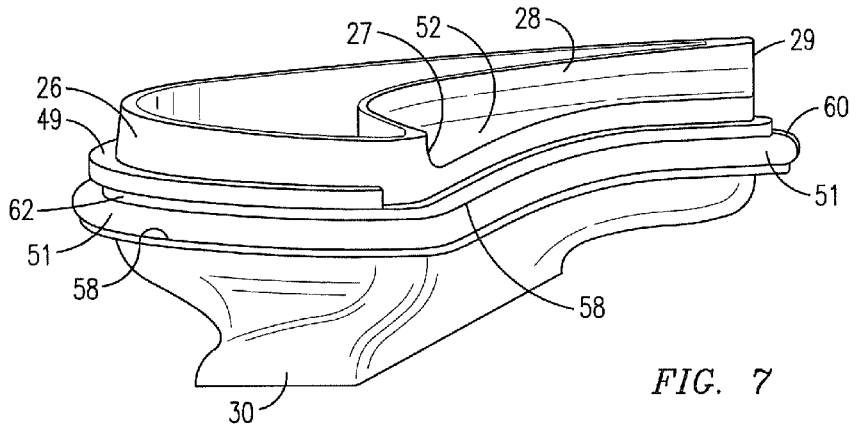
FIG. 7 is a partial perspective view of a blade root, showing a seal wire in a slot.

FIG. 7 is a perspective view of a root portion of a blade, showing a seal wire 51 in a seal slot 58. The wire and slot may encircle the blade as shown. The wire may be formed of a cobalt alloy, and may have a gap 60 at the trailing edge. The seal slot may be formed in a raised portion of the blade around the blade root. The pressure side ridge 52 is part of this raised portion, on which the seal slot and wire may follow the pressure side camber or a lesser curve as previously described per FIG. 2. The seal slot may be bounded in part by the suction side shelf 49. Clearance 62 between the shelf 49 and the seal element 51 allows insertion of the rearward portion 46 of a platform between them during tilted mounting of the platform as previously described.

Figure 8:
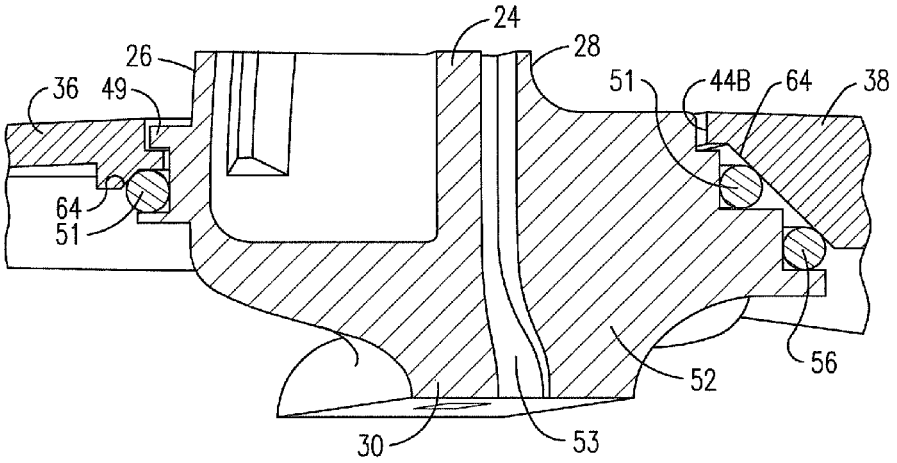
FIG. 8 is a sectional view as in FIG. 3, showing an optional damper pin.

FIG. 8 is a sectional view as in FIG. 3, showing an optional damper pin 56, which may be a straight or constantly curved pin inserted below the seal element 51 and extending between the leading and trailing edges 27, 29. Such pins may serve as both a seal element and a damper element, and may be round or flattened on one side in various embodiments.

Figure 9:
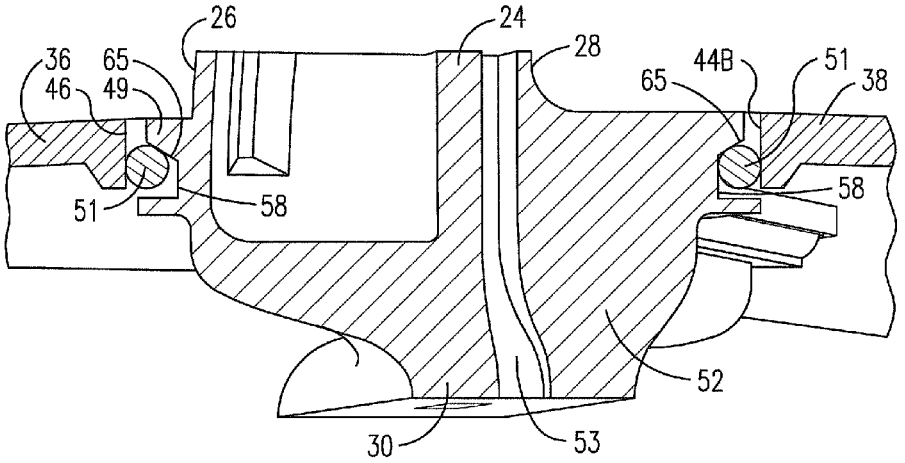
FIG. 9 shows a seal slot embodiment with an upper wedge portion.

FIG. 9 shows a seal slot 58 with an upper wedge portion 65 that cause the seal wire 51 to wedge by centrifugal force against the respective edges 46 and 44B of adjacent platforms 36, 38. The edges 46 and 44B may be vertical in this embodiment. Benefits of the invention include strength and low cost due to a simple blade shape and minimal size, since it is cast without an integral platform. It allows replacing individual platforms radially without replacing or even removing a blade. It eliminates cantilevered centrifugal stress on the platform, and provides effective sealing of the platform. Non-integral platforms facilitate engineered surface contouring that reduces boundary layer vortices and thus energy loss, as described for example in U.S. Pat. Nos. 7,134,842 and 7,690,890.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A turbine blade and platform apparatus, comprising:

first and second turbine blades, each blade comprising a pressure side, a suction side, and a shank portion, wherein the shank portion is mounted to a turbine disk; and a first platform spanning between the pressure side of the first turbine blade and the suction side of the second turbine blade;

wherein the first platform is non-integral with the turbine blades, is mounted to the turbine disk between the first and second blades, and comprises:

a first rotationally forward edge portion that overlies a seal element on the pressure side of the first turbine blade and does not underlie a ledge on the pressure side of the first turbine blade;

a first rotationally rearward edge portion that underlies a shelf on the suction side of the second turbine blade;

the first platform is configured for radial installation and removal between the mounted first and second turbine blades without removal of said blades;

wherein the seal element comprises a wire retained in a seal slot in the first turbine blade; and wherein the seal slot is formed in a ridge on the pressure side of the first turbine blade, the seal slot follows a curved line between a leading edge and a trailing edge of the first turbine blade, and the curved line is less curved than a camber of the pressure side of the first turbine blade.

2. The apparatus of claim 1, wherein the first platform is attached to the disk with a clevis or hinge attachment that allows radial mounting of the first platform onto the disk via tilting of the first platform during mounting effective to provide mounting clearance between the first rotationally rearward edge portion on the first platform and the shelf on the suction side of the second turbine blade.

3. The apparatus of claim 1, further comprising:

a third turbine blade comprising a pressure side, a suction side, and a shank portion, wherein the shank portion is mounted to the turbine disk; and a second platform that is non-integral with the turbine blades and is mounted to the turbine disk between the second and third blades;

wherein the first platform further comprises a second rotationally rearward edge portion that underlies a rotationally forward edge portion on the second platform, forming a ship lap therebetween.

4. The apparatus of claim 1, wherein the curved line is a circular arc.

5. The apparatus of claim 1, wherein the wire and the seal slot are continuous around the pressure side, the suction side, and the leading edge of the first turbine blade.

6. The apparatus of claim 1, further comprising a damper pin below the wire and the seal slot on the pressure side of the first turbine blade.

7. A turbine blade and platform apparatus, comprising:

first, second, and third turbine blades, each blade comprising a pressure side, a suction side, and a shank portion, wherein the shank portion is mounted to a turbine disk;

a first platform mounted to the disk and spanning between the pressure side of the first turbine blade and the suction side of the second turbine blade; and a second platform mounted to the disk and spanning between the pressure side of the second turbine blade and the suction side of the third turbine blade;

wherein the first platform comprises a rotationally rearward edge portion that underlies a rotationally forward edge portion on the second platform, forming a ship lap therebetween that limits centrifugal bending of a rotationally rearward portion of the first platform;

the first platform is designed for individual radial installation and removal between the mounted first turbine blade and the mounted second turbine blade and the mounted second platform;

wherein the first platform further comprises:

a second rotationally rearward edge portion that underlies a shelf on the suction side of the second turbine blade; and a rotationally forward edge portion that overlies a seal element on the pressure side of the first turbine blade and does not underlie a shelf on the pressure side of the first turbine blade;

wherein the seal element comprises a wire in a seal slot in the first turbine blade; and wherein the seal slot is formed in a ridge on the pressure side of the first turbine blade, and the seal slot follows a curved line between a leading edge and a trailing edge of the first turbine blade, and the curved line is less curved than a camber of the pressure side of the first turbine blade.

8. The apparatus of claim 7, wherein the first platform is attached to the disk with a pin attachment that allows radial insertion of the first platform onto the pin attachment via tilting of the first platform during mounting effective to provide mounting clearance between the rotationally rearward edge portion of the first platform and the rotationally forward edge portion of the second platform.

9. The apparatus of claim 7, wherein the curved line is a circular arc.

10. The apparatus of claim 7, wherein the wire and the seal slot are continuous around the pressure side, the suction side, and the leading edge of the first turbine blade.

11. The apparatus of claim 7, further comprising a damper pin below the wire and the seal slot on the pressure side of the first turbine blade.

* * * * *